US011085098B2

(12) United States Patent
Hu et al.

(10) Patent No.: US 11,085,098 B2
(45) Date of Patent: Aug. 10, 2021

(54) GRADE 550MPA HIGH-TEMPERATURE RESISTANT PIPELINE STEEL AND METHOD OF MANUFACTURING SAME

(71) Applicant: Baoshan Iron & Steel Co., Ltd., Shanghai (CN)

(72) Inventors: Ping Hu, Shanghai (CN); Lei Zheng, Shanghai (CN); Chuanguo Zhang, Shanghai (CN)

(73) Assignee: Baoshan Iron & Steel Co., Ltd, Shanghai (CN)

( * ) Notice: Subject to any disclaimer, the term of this patent is extended or adjusted under 35 U.S.C. 154(b) by 368 days.

(21) Appl. No.: 15/512,209

(22) PCT Filed: Sep. 16, 2015

(86) PCT No.: PCT/CN2015/089697
§ 371 (c)(1),
(2) Date: Mar. 17, 2017

(87) PCT Pub. No.: WO2016/041491
PCT Pub. Date: Mar. 24, 2016

(65) Prior Publication Data

US 2017/0283901 A1 Oct. 5, 2017

(30) Foreign Application Priority Data

Sep. 19, 2014 (CN) ..... 201410483553.7

(51) Int. Cl.

| | |
|---|---|
| ***C21D 9/46*** | (2006.01) |
| ***C22C 38/58*** | (2006.01) |
| ***B21B 1/22*** | (2006.01) |
| ***C21D 8/02*** | (2006.01) |
| ***C22C 38/00*** | (2006.01) |
| ***C22C 38/02*** | (2006.01) |
| ***C22C 38/06*** | (2006.01) |
| ***C22C 38/42*** | (2006.01) |
| ***C22C 38/44*** | (2006.01) |
| ***C22C 38/46*** | (2006.01) |
| ***C22C 38/48*** | (2006.01) |
| ***C22C 38/50*** | (2006.01) |

(52) U.S. Cl.
CPC ..... *C21D 9/46* (2013.01); *B21B 1/22* (2013.01); *C21D 8/0205* (2013.01); *C21D 8/0226* (2013.01); *C21D 8/0263* (2013.01); *C22C 38/001* (2013.01); *C22C 38/002* (2013.01); *C22C 38/02* (2013.01); *C22C 38/06* (2013.01); *C22C 38/42* (2013.01); *C22C 38/44* (2013.01); *C22C 38/46* (2013.01); *C22C 38/48* (2013.01); *C22C 38/50* (2013.01); *C22C 38/58* (2013.01); *B21B 2001/225* (2013.01); *C21D 2211/004* (2013.01); *C21D 2211/005* (2013.01)

(58) Field of Classification Search
CPC ..... C21D 9/46; C21D 8/0226; C21D 8/0263; C21D 8/0205; C21D 2211/005; C21D 2211/004; C22C 38/02; C22C 38/46; C22C 38/48; C22C 38/001; C22C 38/002; C22C 38/50; C22C 38/06; C22C 38/42; C22C 38/44; C22C 38/58; B21B 1/22; B21B 2001/225
See application file for complete search history.

(56) References Cited

U.S. PATENT DOCUMENTS

| | | | | |
|---|---|---|---|---|
| 4,388,123 | A * | 6/1983 | Murayama | C22C 38/002 148/320 |
| 4,851,052 | A * | 7/1989 | Nishioka | C22C 38/00 148/546 |
| 2010/0258219 | A1* | 10/2010 | Ahn | C21D 6/005 148/645 |
| 2014/0261915 | A1* | 9/2014 | Ehrhardt | C22C 38/58 148/602 |
| 2016/0053355 | A1* | 2/2016 | Takagi | C22C 38/00 148/637 |
| 2016/0060721 | A1* | 3/2016 | Nagao | C22C 38/00 148/547 |

(Continued)

FOREIGN PATENT DOCUMENTS

| | | | |
|---|---|---|---|
| CN | 1715434 | A | 1/2006 |
| CN | 1715435 | A | 1/2006 |
| CN | 1986861 | A | 6/2007 |
| CN | 101649425 | A | 2/2010 |
| CN | 101906568 | A * | 12/2010 |
| CN | 104264054 | A2 | 1/2015 |
| JP | 2008248330 | A | 10/2008 |

OTHER PUBLICATIONS

English machine translation of CN 101906568 A of Feng published Dec. 8, 2010. (Year: 2010).*

(Continued)

*Primary Examiner* — Jophy S. Koshy
(74) *Attorney, Agent, or Firm* — Quarles & Brady LLP

(57) ABSTRACT

Disclosed is a Grade 550 MPa high temperature-resistant pipeline steel, the chemical elements, in mass percentage, being: 0.061%≤C≤0.120%, 1.70%≤Mn≤2.20%, 0.15%≤Mo≤0.39%, 0.15%≤Cu≤0.30%, 0.15%≤Ni≤0.50%, 0.035%≤Nb≤0.080%, 0.005%≤V≤0.054%, 0.005%≤Ti≤0.030%, 0.015%≤Al≤0.040%, 0.005%≤Ca≤0.035%, and the balance being Fe and unavoidable impurities. Also disclosed is a manufacturing method of the Grade 550 MPa high temperature-resistant pipeline steel, comprising the steps of: smelting, casting, slab heating, rough rolling, finish rolling, controlled cooling, and air cooling to room temperature. The pipeline steel has an excellent mechanical property under a high temperature.

4 Claims, No Drawings

(56) References Cited

U.S. PATENT DOCUMENTS

2016/0289788 A1* 10/2016 Shibata ..... C21D 8/02

OTHER PUBLICATIONS

International Search Reported issued in PCT Application No. PCT/CN2015/089697, dated Dec. 23, 2015, 4 pages.

* cited by examiner

GRADE 550MPA HIGH-TEMPERATURE RESISTANT PIPELINE STEEL AND METHOD OF MANUFACTURING SAME

CROSS-REFERENCES TO RELATED APPLICATIONS

This application represents the U.S. national phase entry of PCT International Application No. PCT/CN2015/089697 filed Sep. 16, 2015, and claims the benefit of Chinese Patent Application No. 201410483553.7 filed on Sep. 19, 2014, incorporated by reference herein.

TECHNICAL FIELD

The disclosure relates to a steel product and a method of manufacturing the same, particularly to a high-temperature resistant pipeline steel and a method of manufacturing the same.

BACKGROUND ART

As the exploitable reserves of traditional oil and natural gas resources decrease day by day, oil sand resources attract more and more attention as supplemental substitute resources, and commercial exploitation thereof is expanded on a larger and larger scale at an annually increasing yield. Nowadays, according to the prior art, oil sands are exploited mainly by infusing high-temperature steam into subterranean oil sand deposits to reduce the viscosity of the oil sands, so as to increase the mobility of the oil sands. For pipeline steel used for delivering this high-temperature steam, two factors, namely the strength and the service temperature of the material, must be taken into account. However, since traditional pipeline steel is mainly used for long-distance delivery of traditional oil and natural gas resources, the major focus is put on the room temperature strength performance of the steel material. In a frozen earth area or an area in a seismic belt, when viewed from the point of strain in design, this traditional pipeline steel must additionally have certain room temperature plasticity, i.e. large strain resistance or low yield ratio. In addition, when the ability of resisting cracking and arresting cracks is taken into consideration, traditional pipeline steel must additionally meet the requirement of toughness, particularly low-temperature toughness. Overall, the attention is mainly drawn to improvement of the room temperature strength, plasticity and low-temperature toughness of traditional pipeline steel. As a result, the pipeline steel used today is not completely suitable for exploitation of oil sand deposits.

On the one hand, from the point of view of improving the weldability of traditional pipeline steel, it's necessary to minimize the addition of C and Mn, Mo, Cr, Cu, Ni, V and other alloy elements to obtain a low carbon equivalent. On the other hand, due to the restricted contents of the alloy elements added, their effect in solid solution strengthening and precipitation strengthening is limited. Hence, the refinement of grains and structures has to be achieved by modifying the manufacture process, for example, using a lower end rolling temperature, a larger rolling reduction rate, or a larger cooling rate; meanwhile, a low-temperature phase change structure is used to obtain high strength and high toughness at the same time. Nevertheless, low contents of alloy elements will reduce the initial strength of the material. Moreover, although a lower end rolling temperature, a larger rolling reduction rate, and rapid cooling can improve the initial strength, these factors will reduce the stability of the high-temperature structure in the material in turn, which is not undesirable for the high-temperature strength of the material. In order to obtain an ability of resisting large deformation or a low yield ratio, it's necessary to form double phase structures in the steel material by design. However, rapid diffusion of the chemical elements between the double phase structures due to concentration difference will reduce the stability of the structures in the material at high temperature, which is also undesirable for the high-temperature strength of the material.

As the steam delivered for exploitation of oil sands at present has a temperature of about 350° C., it's quite necessary to provide a heat resistant pipeline steel having good high-temperature strength for exploitation of oil sand resources.

A Chinese patent reference (publication number: CN1584097A; publication date: Feb. 23, 2005; title: HIGH-STRENGTH AND TOUGHNESS STEEL FOR CONVEYING PIPELINE AND MANUFACTURING METHOD THEREOF) relates to a pipeline steel material. The chemical element compositions (by wt %) of the pipeline steel material are as follows: C: 0.010-0.060; Si: 0.15-0.40; Mn: 1.61-2.00; P: 0.0031-0.018; S≤0.003; Cu: 0.10-0.40; Ni: 0.1-0.4; Nb: 0.051-0.09; Ti: ≤0.025; Mo: 0.1-0.4.

A Japanese patent reference (publication number: JP2012-241271A; publication date: Dec. 10, 2012; title: HIGH STRENGTH SOUR-RESISTANT LINEPIPE SUPERIOR IN COLLAPSE RESISTANCE AND METHOD FOR PRODUCING THE SAME) discloses a linepipe. The chemical element compositions (by wt %) of the linepipe are as follows: C: 0.02-0.08%; Si: 0.01-0.50%; Mn: 0.5-1.5%; P<0.01%; S<0.001%; Cu≤1.0%; Ni≤1.0%; Nb: 0.002-0.100%; Ti: 0.005-0.050%; V: 0.005-0.100%; Mo≤0.5%; Cr: ≤1.0%; Al≤0.06%; Ca: 0.0005-0.0040%; O: ≤0.0030%; Mg: 0.0005-0.0040%; and the balance of Fe and unavoidable impurities.

An American patent reference (publication number: US20120247605A1; publication date: Oct. 10, 2012; title: MOLYBDENUM-FREE, HIGH-STRENGTH, LOW-ALLOY X80 STEEL PLATES FORMED BY TEMPERATURE-CONTROLLED ROLLING WITHOUT ACCELERATED COOLING) discloses a low-alloy X80 steel plate, the chemical elements in mass percentage thereof are as follows: C: 0.05-0.09%, Mn: 1.7-1.95%, P<0.015%, S<0.003%, Nb: 0.075-0.1%, Ti: 0.01-0.02%, V: 0.01-0.03%, Mo: Al: 0.02-0.055%; and the balance of Fe and unavoidable impurities.

The above linepipe related patents which have already been published do not address the high-temperature properties of the linepipes.

SUMMARY

One object of the disclosure is to provide a Grade 550 MPa high-temperature resistant pipeline steel showing superior high-temperature mechanical properties, wherein the high-temperature resistant pipeline steel has a yield strength of 520 MPa or more and a tensile strength of 645 MPa or more at 200-400° C. In addition, the high-temperature resistant pipeline steel has strengths of Grades 550 MPa and 625 MPa or higher (equivalent to the strength requirements of Grade X80) at room temperature. Hence, the pipeline steel can provide normal service at both room temperature and a temperature in the range of 200-400° C.

In order to fulfill the above object, the disclosure provides a Grade 550 MPa high-temperature resistant pipeline steel, the mass percentage of the chemical elements thereof being:

C: 0.061-0.120%;
Mn: 1.70-2.20%;
Mo: 0.15-0.39%;
Cu: 0.15-0.30%;
Ni: 0.15-0.50%;
Nb: 0.035-0.080%;
V: 0.005-0.054%;
Ti: 0.005-0.030%;
Al: 0.015-0.040%;
Ca: 0.005-0.035%; and
the balance being Fe and other unavoidable impurities.

The unavoidable impurities in the technical solution of this disclosure mainly refer to elements P and S which tend to develop deficiencies of segregation, inclusions and the like, which are undesirable for the toughness of the material. In the present technical solution, it is controlled that P≤0.010% and S≤0.005%.

The principle for designing the various chemical elements in the Grade 550 MPa high-temperature resistant pipeline steel according to the disclosure is described as follows:

C: C is the most basic strengthening element in steel. On the one hand, it has the effect of interstitial solid solution strengthening; and on the other hand, it can form carbides with alloy elements, leading to the effect of precipitation strengthening when the carbides precipitate. C can form fine nanocarbides with microalloy elements Nb and V, thereby further leading to the effect of precipitation strengthening. Additionally, C is an essential element for stabilizing austenite. It can improve the hardenability and strength of the steel. However, as the C content increases, the toughness and weldability of the steel decreases gradually. Moreover, as the C content increases, the temperature for complete solid dissolution of NbC also increases correspondingly. As such, if complete solid dissolution of NbC is required, the heating temperature necessary for rolling will be increased accordingly, resulting in coarsening as the high temperature facilitates premature precipitation of NbC. Therefore, the C content in the Grade 550 MPa high-temperature resistant pipeline steel according to the disclosure is controlled at 0.061-0.12 wt. %.

Mn: Mn is the most basic alloy element in low-alloy, high-strength steel, and has the effect of solid solution strengthening. Increase of the content of element Mn within a certain range can increase the strength of the material while the toughness of the material is sustained. In addition, Mn is also an element that can enlarge the austenite phase zone. It can decrease the temperature at which phase change from austenite to ferrite occurs in steel, thereby facilitating generation of fine products from the phase change, and increasing the obdurability of the material. However, if there is an excessive amount of Mn in the material, continuously cast billets are susceptible to central segregation. As a result, the composition and structure at the center and other positions across the thickness are not uniform. Particularly, diffusion of this element will be expedited at high temperature, which is undesirable for high-temperature properties. Meanwhile, an excessive amount of element Mn in the material is also not favorable for its effect of increasing strength. Hence, the content of element Mn in the technical solution according to the disclosure is controlled at 1.70-2.20 wt. %.

Mo: On the one hand, as an element for solid solution strengthening, Mo can increase the strength of the material. On the other hand, Mo can also improve the hardenability of the material, delay phase change of ferrite in the steel, allow acquisition of needle-shaped ferrite structure or bainite structure in the material even at a low cooling rate, and refine the structures by lowering the temperature of phase change, thereby improving the strength of the material. Furthermore, Mo can increase the solid solubility of Nb, so that fine NbC can precipitate from more Nb at lower temperature, thereby improving the effect of precipitation strengthening, leading to increased strength of the material. Mo can also decrease the diffusion coefficient of C, and improve the stability of the structures, facilitating acquisition of higher high-temperature strength of the material. However, an excessive content of element Mo will promote formation of M-A islands, which is undesirable for both the toughness and the structural homogeneity of the material, and also increases the manufacture cost. Therefore, it's necessary to control the Mo content at 0.15-0.39 wt. % in order to fulfill the effect of element Mo in promoting strengthening and avoid impact on toughness and structural homogeneity due to undue addition of element Mo according to the technical solution of the disclosure.

Cu/Ni: As elements for solid solution strengthening, Cu and Ni can increase strength. Additionally, Cu can also improve the corrosion resistance of steel, and Ni can improve the toughness of steel and alleviate the hot shortness caused by Cu in the steel. In addition, Cu can also decrease the diffusion coefficient of C, and improve structural stability, facilitating acquisition of higher high-temperature strength of the material. In view of these reasons, the Cu content should be controlled at 0.15-0.30 wt. %, and the Ni content should be controlled at 0.15~0.50 wt. % in the Grade 550 MPa high-temperature resistant pipeline steel according to the disclosure.

Nb: First, Nb has the effect of delaying austenite recrystallization and increasing the temperature of austenite recrystallization in steel, facilitating reduction of the load of a rolling machine. Second, Nb can also reduce phase change temperature and delay phase change of ferrite, so as to refine grains and structures, and thereby increase the strength of the material. Finally, Nb can also combine with C in the process of hot rolling and the subsequent process of cooling to form a fine precipitate phase of NbC, so as to fulfill the effect of precipitation strengthening, thereby increasing the strength of the material. However, an excessive content of Nb cannot be solid-dissolved completely. As a result, it not only cannot play its role, but also can add to the production cost. Moreover, an excessive content of Nb will cause premature precipitation of NbC at high temperature, resulting in large NbC, which is not favorable for increasing the strength of the material by precipitation strengthening. Therefore, the content of Nb added in the Grade 550 MPa high-temperature resistant pipeline steel according to the disclosure should be controlled at 0.035-0.080 wt. %.

V: V is a typical element for precipitation strengthening, and it can combine with C to form VC. The temperature of VC precipitation is lower than those of TiC and NbC. VC can precipitate in the process of rolling and the subsequent process of cooling. VC is fine in size, which is desirable for increasing the strength of the material. However, an excessive content of V will have a negative influence on the toughness of the material. Therefore, the V content in the Grade 550 MPa high-temperature resistant pipeline steel according to the disclosure is controlled at 0.005-0.054 wt. %.

Ti: Ti can combine with N to form TiN. Hence, it acts to immobilize N, so as to improve the toughness of the material. The use of about 0.02 wt. % Ti is enough to immobilize 60 ppm (0.006%) or less N in steel. In a continuous casting process, Ti can also form TiN with N. During heating, TiN formed at high temperature can also act to impede growth and coarsening of austenite grains. TiN formed from element Ti is also favorable for improving the impact toughness of a welding heat affected zone. The combination of Ti with N consumes element N, which allows for solid solution of more Nb at high temperature, so that recrystallization is inhibited. Therefore, the Ti content in the technical solution of the disclosure should be controlled at 0.005-0.030 wt. %

Al: Element Al is mainly used to remove oxygen from steel. The nitrides formed from Al and N can improve the toughness of a welding heat affected zone. However, increase of the Al content will allow for formation of aluminum oxides which will decrease the toughness of a base material and a welding heat affected zone. Therefore, the Al content in the Grade 550 MPa high-temperature resistant pipeline steel according to the disclosure is controlled at 0.015-0.040 wt. %.

Ca: Ca is mainly used to modify inclusions, so that the inclusions are spheroidized and distributed evenly, thereby reducing the influence of the inclusions on toughness and corrosion resistance. However, an increased content of Ca will lead to formation of fascicular inclusions which will affect the corrosion resistance of the material. Therefore, the Ca content in the Grade 550 MPa high-temperature resistant pipeline steel according to the disclosure is controlled at 0.005-0.035 wt. %.

As seen from the principle for designing the various chemical elements as described above, the technical solution of the disclosure uses a C-Mn steel as a basis, and improves the high-temperature strength of this material by composite microalloying of Nb-V-Ti, composite strengthening of precipitation—solid solution, and addition of relatively large amounts of various alloy elements such as Mo, Cu, Ni and the like. First, microalloy elements Nb-V-Ti have the effects of refining grains, refining structures and precipitation strengthening. Second, Mn-Mo-Cu have the effect of solid solution strengthening, wherein Mo and Cu added can reduce the diffusion coefficient of C, and can also improve structural stability at high temperature, so as to improve high-temperature strength. Meanwhile, Mo further increases hardenability strongly, and thus acts to promote transformation of needle-shaped ferrite structure or bainite structure, thereby increasing the initial strength of the material and the structural stability at high temperature, and thus increasing the high-temperature strength of the material.

As compared with the prior art pipeline steel, the core of the design of the technical solution according to the disclosure lies in the increase of the high-temperature strength of the material.

Further, the Grade 550 MPa high-temperature resistant pipeline steel according to the disclosure also comprises at least one of $0<Si\leq0.40\%$, $0<Cr\leq0.40\%$ and $0<N\leq0.005\%$.

Si is mainly used to remove oxygen from steel. Meanwhile, it also has some effect of increasing hardenability. However, when the Si content is unduly high, toughness will be decreased; particularly, the toughness of a welding heat-affected zone will be exasperated, i.e. leading to degraded weldability of the steel material. In view of these reasons, the content of Si added in the technical solution of the disclosure should be controlled to be ≤0.40 wt. %.

Cr is an element for increasing steel strength by increasing steel hardenability. However, as the Cr content increases, the cold cracking sensitivity of the steel will be increased gradually, thereby producing undesirable influence on the toughness of the welding heat-affected zone and the weldability. For this reason, the content of Cr added in the technical solution of the disclosure should be controlled to be ≤0.40 wt. %.

N increases steel strength by increasing steel hardenability. However, N will produce undesirable influence on steel toughness. Ti may be added to form TiN to improve the toughness of the material. Therefore, the N content in the Grade 550 MPa high-temperature resistant pipeline steel according to the disclosure is controlled at 0.005% or less.

The microstructure of the Grade 550 MPa high temperature resistant pipeline steel according to the disclosure comprises a matrix formed from a homogeneous needle-shaped ferrite structure+a small amount of M-A component (martensite-residual austenite component). On the one hand, a needle-shaped ferrite structure is finer than a polygonal ferrite structure, helpful for increasing high temperature strength by interface strengthening; on the other hand, a needle-shaped ferrite structure has a lower dislocation density than a martensite structure, helpful for increasing high-temperature strength by increasing structural stability at high temperature.

Further, the M-A component has a volumetric percentage ≤10%. The M-A component is generated from overcooled austenite which has no time to transform in the course of cooling after controlled rolling. The composition of the M-A component is different from that of the needle-shaped ferrite surrounding it, thereby forming a concentration gradient. If the volumetric percentage of the M-A component is too high, element diffusion at high temperature will be accelerated, which is undesirable for the structural stability at high temperature, and in turn, undesirable for the high-temperature strength. In addition, the M-A component and the needle-shaped ferrite exhibit different deformation compatibility, and thus cracks tend to be generated therebetween when deformation occurs under stress, undesirable for the high-temperature strength.

Further, the matrix has an average effective grain size ≤8 μm. Restriction of the effective grain size to this range can further promote the effect of interface strengthening, and thus increase the high-temperature strength.

Still further, the matrix has a volumetric percentage of a small angle grain boundary of 20-60%. The small angle grain boundary refers to a grain boundary having a phase difference less than 15 degrees crystallographically. Restriction of the small angle grain boundary content in the matrix to this range can also promote the effect of interface strengthening, and thus increase the high-temperature strength.

Further, precipitated carbides NbC, VC and carbonitrides (Nb, V) (C, N) formed from Nb and V are dispersively distributed on the matrix. NbC, VC and (Nb, V) (C, N) have a low coarsening rate, and effective precipitation strengthening can be maintained at high temperature for a long time, thereby increasing the high-temperature strength.

Still further, the carbides and carbonitrides have an average size of 5-50 nm. Restriction of the size of the carbides and carbonitrides to this range facilitates strong precipitation strengthening, thereby increasing the high-temperature strength.

Accordingly, the disclosure further provides a method of manufacturing the Grade 550 MPa high-temperature resistant pipeline steel as described above, comprising the following steps: smelting; casting; slab heating; rough rolling; finish rolling; controlled cooling; air cooling to room temperature.

Further, in the rough rolling step of the method of manufacturing the Grade 550 MPa high-temperature resistant pipeline steel according to the disclosure, an initial rolling temperature of the rough rolling is 1100-1180° C., and an end rolling temperature of the rough rolling is 950-980° C.

Further, in the finish rolling step of the method of manufacturing the Grade 550 MPa high-temperature resistant pipeline steel according to the disclosure, an initial rolling temperature of the finish rolling is 850-900° C.; an end rolling temperature of the finish rolling is 800-820° C.; and a finish rolling compression ratio is 4T-8T, wherein T is a thickness of a final steel plate.

In the technical solution of the disclosure, on the basis of the composite microalloying of Nb-V-Ti, formation of fine precipitated phase is facilitated by strain induced precipitation due to the use of a relatively large finish rolling compression ratio, so as to promote the precipitation strengthening effect, and thus increase the high-temperature strength by the fine precipitated phase. A relatively high finish rolling temperature can improve the stability of the initial structure of the material, thereby increasing the high-temperature strength of the material.

Still further, in the controlled cooling step of the method of manufacturing the Grade 550 MPa high-temperature resistant pipeline steel according to the disclosure, an initial cooling temperature is 750-780° C.; a cooling rate is 15-30° C./s; and an end cooling temperature is 380-580° C.

In the cooling step, the use of a medium cooling rate and a relatively high end cooling temperature can decrease the mobile dislocation density in the initial structure, so as to improve the structural stability of the material at high temperature, thereby increasing the high-temperature strength of the material.

Still further, in the slab heating step of the method of manufacturing the Grade 550 MPa high-temperature resistant pipeline steel according to the disclosure, a heating temperature is 1110-1250° C.

The critical point of the method of manufacturing the Grade 550 MPa high-temperature resistant pipeline steel according to the disclosure is the use of a TMCP controlled rolling/controlled cooling process to improve high-temperature strength of a material on the basis of addition of relatively large amounts of alloy elements such as Nb, V, Ti, Mn, Mo, Cu and the like in the design of the composition.

As compared with the pipeline steel in the prior art, the Grade 550 MPa high-temperature resistant pipeline steel according to the disclosure possesses both excellent high-temperature mechanical properties and superior high-temperature resistant properties, wherein the steel has a yield strength of 520 MPa or greater and a tensile strength of 645 MPa or greater at 200-400° C., and a yield strength of 550 MPa or greater and a tensile strength of 625 MPa or greater at room temperature. The steel can be used to deliver a high-temperature steam medium in the in-situ exploitation of oil sands.

In addition, the Grade 550 MPa high-temperature resistant pipeline steel according to the disclosure also has relatively high toughness, good corrosion resistance and superior weldability.

Owing to the use of a controlled rolling/controlled cooling process, the method of manufacturing the Grade 550 MPa high-temperature resistant pipeline steel according to the disclosure increases the high-temperature mechanical properties of the pipeline steel, particularly the room-temperature strength and the high-temperature strength of the pipeline steel.

DETAILED DESCRIPTION

The Grade 550 MPa high-temperature resistant pipeline steel according to the disclosure and the method of manufacturing the same will be illustrated further with reference to the following specific Examples, but the specific Examples and the related description should not be construed to limit the technical solutions of the invention unduly.

EXAMPLES A1-A6

Grade 550 MPa high-temperature resistant pipeline steel in Examples A1-A6 was manufactured according the following steps:

1) Smelting: Smelting was conducted in a converter or electrical furnace, and the mass percentages of the various chemical elements in Examples A1-A6 were controlled as shown in Table 1;

2) Casting: Slabs were formed by casting;

3) Slab heating: The heating temperature was 1110-1250° C.

4) Rough rolling: The initial rolling temperature of the rough rolling was 1100-1180° C., and the end rolling temperature was 950-980° C.

5) Finish rolling: The initial rolling temperature of the finish rolling was 850-900° C.; the end rolling temperature was 800-820° C.; the compression ratio of the finish rolling was 4 T-8 T, wherein T was the thickness of the final steel plate;

6) Controlled cooling: The initial cooling temperature was 750-780° C.; the cooling rate was 15-30° C./s; and the end cooling temperature was 380-580° C.;

7) After air cooled to room temperature, the Grade 550 MPa high-temperature resistant pipeline steel of Examples A1-A6 was obtained finally, and the process parameters involved in the specific steps were listed in Table 2.

Table 1 lists the mass percentages of the various chemical elements in Examples A1-A6 in this disclosure.

TABLE 1

(wt %, the balance is Fe and other unavoidable impurities except for P and S)

| No. | C | Mn | Mo | Cu | Ni | Nb | V | Ti | Al | Ca | Si | Cr | N | P | S |
|---|---|---|---|---|---|---|---|---|---|---|---|---|---|---|---|
| A1 | 0.062 | 2.15 | 0.16 | 0.28 | 0.48 | 0.079 | 0.010 | 0.026 | 0.018 | 0.020 | 0.25 | 0.28 | 0.003 | 0.008 | 0.0022 |
| A2 | 0.111 | 1.73 | 0.36 | 0.24 | 0.30 | 0.036 | 0.050 | 0.020 | 0.022 | 0.019 | 0.20 | 0.36 | 0.004 | 0.008 | 0.0035 |
| A3 | 0.105 | 1.75 | 0.32 | 0.17 | 0.18 | 0.041 | 0.020 | 0.016 | 0.017 | 0.022 | 0.21 | 0.19 | 0.004 | 0.007 | 0.0040 |
| A4 | 0.070 | 2.05 | 0.18 | 0.28 | 0.42 | 0.065 | 0.025 | 0.024 | 0.023 | 0.018 | 0.24 | 0.22 | 0.003 | 0.009 | 0.0035 |
| A5 | 0.079 | 1.96 | 0.25 | 0.20 | 0.25 | 0.054 | 0.040 | 0.020 | 0.022 | 0.023 | 0.24 | 0.18 | 0.004 | 0.007 | 0.0020 |
| A6 | 0.089 | 1.85 | 0.30 | 0.16 | 0.18 | 0.048 | 0.050 | 0.016 | 0.016 | 0.028 | 0.22 | 0.18 | 0.003 | 0.009 | 0.0030 |

Table 2 lists the process parameters of the method of manufacturing the Grade 550 MPa high-temperature resistant pipeline steel of Examples A1-A6.

TABLE 2

| | Slab | Rough Rolling | | Finish Rolling | | |
|---|---|---|---|---|---|---|
| No. | Heating Heating Temperature (° C.) | Initial Rolling Temperature (° C.) | End Rolling Temperature (° C.) | Initial Rolling Temperature (° C.) | End Rolling Temperature (° C.) | Finish Rolling Compression Ratio |
| A1 | 1230 | 1170 | 950 | 895 | 805 | 7.3T |
| A2 | 1150 | 1135 | 980 | 880 | 820 | 5.8T |
| A3 | 1170 | 1150 | 970 | 870 | 815 | 5.0T |
| A4 | 1200 | 1180 | 980 | 860 | 810 | 4.5T |
| A5 | 1115 | 1100 | 950 | 890 | 820 | 5.9T |
| A6 | 1130 | 1120 | 960 | 880 | 805 | 7.3T |

| | Cooling | | | Miscellaneous | |
|---|---|---|---|---|---|
| | | | | Intermediate | |
| No. | Initial Cooling Temperature (° C.) | Cooling Rate (° C./s) | End Cooling Temperature (° C.) | Temperature-holding Thickness (mm) | Final Product Thickness T (mm) |
| A1 | 755 | 24 | 500 | 140 | 19.1 |
| A2 | 775 | 15 | 580 | 115 | 20.0 |
| A3 | 755 | 22 | 500 | 110 | 22.2 |
| A4 | 770 | 26 | 460 | 115 | 25.4 |
| A5 | 760 | 30 | 390 | 155 | 25.4 |
| A6 | 775 | 18 | 560 | 145 | 20.0 |

The final steel plates of Examples A1-A6 were subjected to rod tensile testing, wherein the test temperatures were room temperature, 200° C., 250° C., 300° C., 350° C. and 400° C. The specific values of the tensile properties obtained at the above temperatures are shown in Table 3.

Table 3 lists the values of the tensile properties of the Grade 550 MPa high-temperature resistant pipeline steel of Examples A1-A6 at different temperatures according to the disclosure.

TABLE 3

| | Room Temperature | | | 200° C. | | | 250° C. | | |
|---|---|---|---|---|---|---|---|---|---|
| No. | Rt0.5 (MPa) | Rm (MPa) | A50.8 (%) | Rt0.5 (MPa) | Rm (MPa) | A50* (%) | Rt0.5 (MPa) | Rm (MPa) | A50 (%) |
| A1 | 571 | 682 | 24 | 568 | 674 | 23 | 560 | 679 | 25 |
| A2 | 584 | 694 | 23 | 589 | 685 | 23 | 571 | 705 | 24 |
| A3 | 593 | 690 | 22 | 595 | 684 | 22 | 576 | 710 | 23 |
| A4 | 612 | 703 | 24 | 608 | 696 | 23 | 593 | 716 | 25 |
| A5 | 625 | 746 | 21 | 618 | 733 | 21 | 607 | 747 | 24 |
| A6 | 614 | 723 | 23 | 619 | 706 | 23 | 594 | 738 | 23 |

| | 300° C. | | | 350° C. | | | 400° C. | | |
|---|---|---|---|---|---|---|---|---|---|
| No. | Rt0.5 (MPa) | Rm (MPa) | A50 (%) | Rt0.5 (MPa) | Rm (MPa) | A50 (%) | Rt0.5 (MPa) | Rm (MPa) | A50 (%) |
| A1 | 591 | 732 | 22 | 558 | 685 | 26 | 545 | 688 | 27 |
| A2 | 602 | 743 | 21 | 569 | 702 | 24 | 548 | 697 | 25 |
| A3 | 615 | 738 | 21 | 580 | 705 | 23 | 560 | 710 | 24 |
| A4 | 620 | 750 | 22 | 597 | 714 | 25 | 572 | 716 | 26 |
| A5 | 632 | 772 | 21 | 612 | 753 | 23 | 593 | 748 | 24 |
| A6 | 641 | 757 | 21 | 601 | 728 | 24 | 585 | 735 | 25 |

*Note: (1) Rt0.5 is yield strength, which refers to a tensile stress when a total elongation of 0.5% is generated in terms of a gauge length of a material; (2) Rm is tensile strength; A50.8 is a total elongation when a gauge length is 50.8 mm; a round rod specimen for testing A50.8 in Table 3 has a diameter of 12.8 mm; (3) A50 is a total elongation when a gauge length is 50 mm; a round rod tensile specimen for testing A50 in Table 3 has a diameter of 10 mm.

As can be seen from Table 3, the pipeline steel plates of Examples A1-A6 have a yield strength ≥571 Mpa, a tensile strength ≥682 Mpa and an elongation ≥21% at room temperature, and a yield strength ≥545 Mpa, a tensile strength ≥679 Mpa and an elongation ≥21% at high temperatures (200-400° C.). This indicates that the room-temperature tensile strength of the pipeline steel of Examples A1-A6 can meet the requirement of the strength of Grade X80 (i.e. the yield strength and tensile strength at room temperature reach ≥550 MPa and ≥625 MPa respectively), and this pipeline steel also possesses relatively high yield strength and tensile strength at 200-400° C.

The Grade 550 MPa high-temperature resistant pipeline steel according to the disclosure may be used for manufacture of steam delivering pipes operating at 200-400° C., and is anticipated to be used widely in markets.

It is to be noted that there are listed above only specific Examples of the invention. Obviously, the invention is not limited to the above Examples. Instead, there exist many similar variations. All variations derived or envisioned directly from the disclosure of the invention by those skilled in the art should be all included in the protection scope of the invention.

What is claimed is:

1. A pipeline steel, comprising, in mass percentages: 0.061%≤C≤0.120%; 1.70%≤Mn≤2.20%; 0.15%≤Mo≤0.39%; 0.15%≤Cu≤0.30%; 0.15%≤Ni≤0.50%; 0.035%≤Nb≤0.080%; 0.005%≤V≤0.054%; 0.005%≤Ti≤0.030%; 0.015%≤Al≤0.040%; 0.005%<Ca≤0.035%, 0.18<Cr≤0.40%, and 0<N≤0.005%, and the balance being Fe and unavoidable impurities;

wherein the steel has a yield strength of 520 MPa to 641 MPa and a tensile strength of 645 MPa to 772 MPa at 200-400° C., and a yield strength of 550 MPa to 625 MPa and a tensile strength of 625 MPa to 746 MPa at room temperature;

wherein the steel has a microstructure consisting of a matrix formed from a needle-shaped ferrite structure and martensite-residual austenite component having a volumetric percentage ≤10% based on the total volume of the microstructure, and the matrix has a volumetric percentage of a small angle grain boundary of 20-60%, wherein the small angle grain boundary refers to a grain boundary having a phase difference less than 15 degrees crystallographically;

wherein precipitated carbides, NbC and VC, and carbonitrides (Nb, V) (C, N), formed from Nb and V are distributed in the matrix, and the carbides and carbonitrides have an average size of 5-50 nm; and wherein the matrix has an average effective grain size ≤8 μm.

2. The pipeline steel according to claim 1, further comprising 0<Si≤0.40% in mass percentages.

3. A method of manufacturing the pipeline steel of claim 1, comprising the following steps: smelting; casting; slab heating; rough rolling; finish rolling; controlled cooling; and air cooling to room temperature;

wherein in the rough rolling step, an initial rolling temperature of the rough rolling is 1100-1180° C., and an end rolling temperature of the rough rolling is 950-980° C.;

wherein in the finish rolling step, an initial rolling temperature of the finish rolling is 850-900° C.; an end rolling temperature of the finish rolling is 800-820° C.; and a finish rolling compression ratio is 4T-8T, wherein T is a thickness of a final steel plate; and wherein in the controlled cooling step, an initial cooling temperature is 750-780° C.; a cooling rate is 15-30° C./s; and an end cooling temperature is 380-580° C.

4. The method of manufacturing the pipeline steel according to claim 3, wherein in the slab heating step, a heating temperature is 1110-1250° C.

* * * * *